US006169964B1

(12) United States Patent
Aisa et al.

(10) Patent No.: US 6,169,964 B1
(45) **Date of Patent: *Jan. 2, 2001**

(54) APPARATUS FOR CONTROLLING CONSUMPTION BY A HOUSEHOLD APPLIANCE

(75) Inventors: Valerio Aisa; Dino Bongini, both of Fabriano (IT)

(73) Assignee: Merloni Elettrodomestici S.p.A., Fabriano (IT)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/978,350

(22) Filed: Nov. 25, 1997

(30) Foreign Application Priority Data

Nov. 25, 1919 (IT) ..... TO96A0948

(51) Int. Cl.[7] ..... H02J 3/00
(52) U.S. Cl. ..... 702/136; 364/528.26; 364/528.3
(58) Field of Search ..... 702/84, 136; 364/188, 364/468.15, 468.16, 475.09, 528.26, 528.3, 528.31

(56) References Cited

U.S. PATENT DOCUMENTS

| | | | |
|---|---|---|---|
| 4,035,795 | 7/1977 | Fosnough et al. | 307/141.4 |
| 4,275,464 | 6/1981 | Schmidt | 364/477.04 |
| 4,583,182 | 4/1986 | Breddan | 364/528.26 |
| 4,686,630 | 8/1987 | Marsland et al. | 364/528.31 |
| 4,916,328 | 4/1990 | Culp, III | 364/528.3 |
| 5,414,640 | 5/1995 | Seem | 364/528.26 |

FOREIGN PATENT DOCUMENTS 39 32 170 4/1991 (DE) .

*Primary Examiner*—Mark S. Hoff
*Assistant Examiner*—Bryan Bui
(74) *Attorney, Agent, or Firm*—Levine & Mandelbaum

(57) ABSTRACT

A system for controlling the consumption of a household appliance, comprising an electronic microcontroller and non-volatile memory device associated with the microcontroller, the household appliance being connected during use with at least one source of an external resource (water, electric energy, gas, etc.), the external resource being required by the apparatus for carrying out an operating cycle, where the apparatus also comprises a setting device for the manual selection of one or more operating parameters, and signaling device. Coded information are contained within a memory, which are used by the control system as a function of at least one selection actuated through the setting device, for calculating the consumption of the external resource required by the household appliance to execute an operating cycle, the signaling means being capable, if required, to show the consumption level of the external resource.

27 Claims, 5 Drawing Sheets

APPARATUS FOR CONTROLLING CONSUMPTION BY A HOUSEHOLD APPLIANCE

FIELD OF THE INVENTION

The present invention relates to apparatus for controlling the consumption of energy and resources by a household appliance, such as a washing machine.

BACKGROUND OF THE INVENTION

It is known that through improper use of a household appliance a waste of energy will ensue in the majority of cases.

In the specific case of a washing machine, for instance, it happens quite frequently that following an improper use of the appliance, waste does not only involve electric energy, but also water and detergent. Quite often, in fact, the user adds more detergent than is warranted for washing and cleaning laundry. This not only increases the quantity of polluting residues released to the environment, but will also require an increased quantity of water to rinse the clothes adequately. Similar problems may also occur for dishwashers, and an incorrect control setting in the use of refrigerators and baking ovens will also lead to energy waste.

In the specific case of a washing machine it also happens that for the washing of resistant clothes (e.g. white cottons) some users tend to use wash cycles at high temperature (typically 90° C.), having acquired such a habit in the past when detergent powders still contained bleaches (phosphate based oxidants, no longer permitted by law due to their highly polluting effect) that were activated only under high temperature conditions. However, since detergents are now phosphate free as they contain other bleach types effective at lower temperatures (typically 60° C.) and are also rich in enzymes (biologic elements that become active at 30–60° C.), washing can take place at 60° C. to obtain satisfactory cleanliness. Heating water up to 90° C. instead of 60° C. will obviously require a higher energy consumption.

Moreover, washing machines are now featured with a preset number of wash programs and options (temperature setting, spin speed setting, reduced laundry load, etc.) differing from one model to another and tending to increase the machine cost proportionally. Various programs are associated with different types of fabrics, and options allow the user to customize the selected wash-cycle.

The situation can be summarized as follows:

- energy consumption mainly depends on the type of laundry, its quantity, the temperature of the washing water, the type of program selected by the user and the availability of hot water;
- water consumption depends upon the type of laundry, its quantity and the number of rinses associated with the program selected by the user;
- detergent consumption is essentially dictated by the user (habits, culture, experience, etc.).

Household appliances usually known do not give direct indications to the user about consumption of external resources (electric energy, water, detergent aid, gas, etc.) associated with a specific selected program and available options. The only information related to energy and/or resource consumption associated with different situations (e.g., type of program and/or type of clothes for washing machines) are included in the instructions for use delivered with the appliance; however, these do not always contain exhaustive data.

Only with reference to detergent consumption, some types of washing-machines, by giving the user information concerning water hardness, allow for a more correct metering of detergents according to the instructions on the package.

SUMMARY OF THE INVENTION

It is an object of the present invention to overcome the above problems and provide a household appliance fitted with a proper control system capable of solving any waste problem of 'primary' or external resources, (energy, water, gas, etc.), and making the user 'aware' of the resource consumption associated with his or her selections, through adequate 'feedback' instruments or 'dialog' devices during the interaction of the user with the appliance (i.e. type of program, options, etc.).

DESCRIPTION OF THE DRAWINGS

Further purposes, features and advantages of the present invention will be apparent from the following detailed description and annexed drawings, which are supplied by way of an explanatory, not limiting, example only, wherein.

DESCRIPTION OF THE PREFERRED EMBODIMENT

Figure 1:
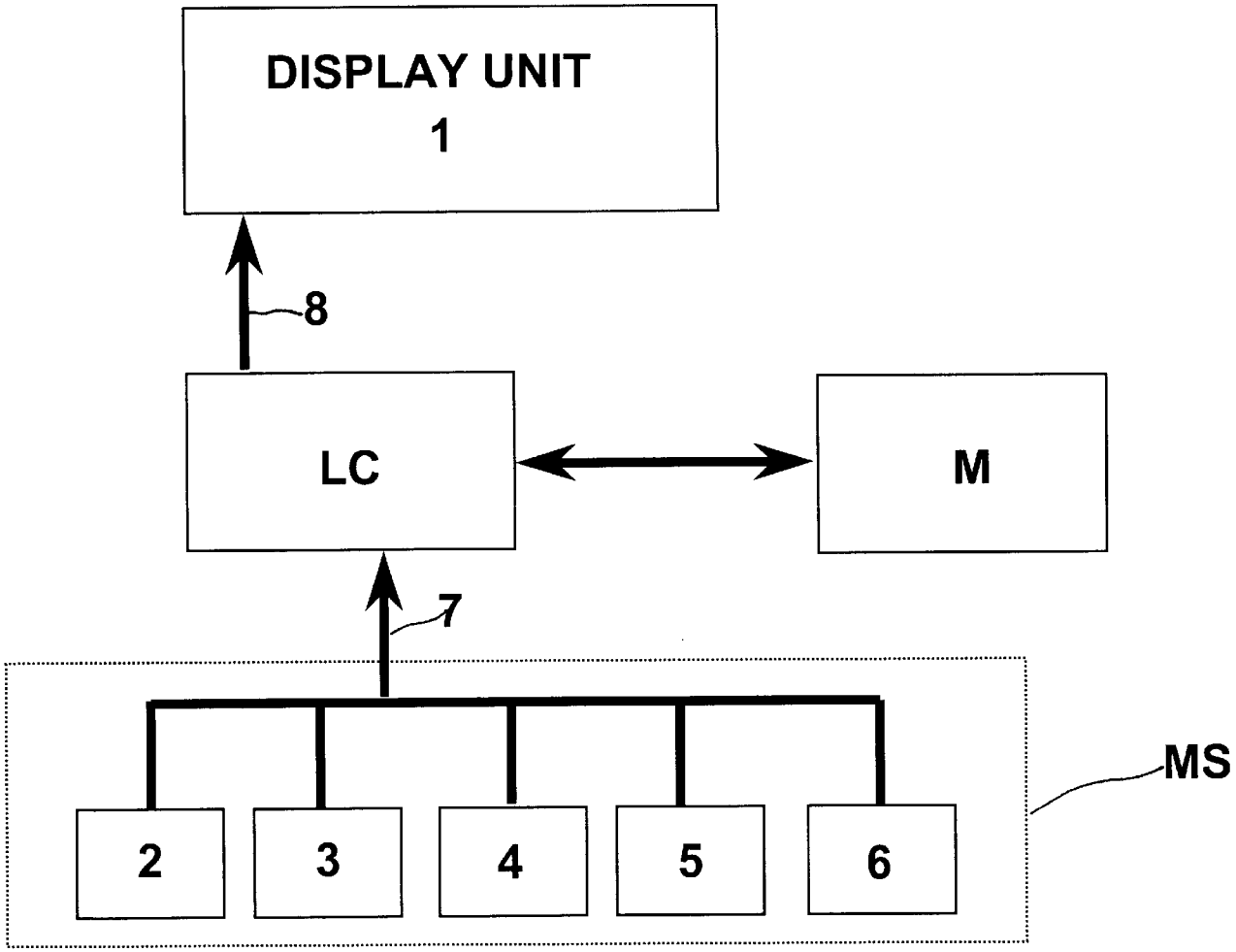
FIG. 1 shows schematically a part of the control system of a household appliance according to the invention.

In FIG. 1 a part of a control system of a household appliance is schematically shown, provided according to the characteristics of the present invention. In such an example, the appliance is a washing machine, not shown as a whole for simplicity's sake.

In FIG. 1, reference number 1 indicates a display unit as a whole and MS a plurality of sensors which are provided in the washing machine and allow measurement of various quantities related to its operation.

To this purpose, number 2 indicates a temperature sensor, for example a thermosensitive element of the NTC type, for measurement of the washing liquid's temperature; number 3 indicates a pressure switch that, in addition to its standard function as a water level sensor, operates along with an electronic control system of the washing machine as a sensor of the quantity of laundry, of the quantity of water used for washing, and of the type of fabric.

As to the operating procedure of a common first-level electromechanical pressure switch combined with an electronic control system to identify the three quantities above (fabric type, quantity of laundry and quantity of water) reference may be made, for instance, to European Patent Application EP-A-0 649 932.

However, it should be noted that the three quantities can also be detected through different individual sensors, in themselves known.

Number 4 indicates a sensor to detect the quantity of detergent used, whose operation may be based for instance on measuring the resistivity of the washing water. To this purpose reference could be made to the European Patent Application EP-A-0 582 329, describing a device capable of measuring the water resistivity and obtain a number of informative data from such a measurement, being useful for the control of the operation of a washing machine, such as for instance ionic concentration of detergent in water, water hardness degree, kind of soil associated with the laundry, and so on.

Number 5 indicates a measuring device of the electric energy absorbed by the machine during operation. Such an energy measuring device can be obtained exploiting, for instance, the capacities offered by the electronic control system of the appliance according to the invention. Within this frame, according to a preferred embodiment of the invention, such an energy measuring device can be obtained through the same electronic control system of the appliance, adequately programmed, for calculating with a good approximation, the individual consumptions of its electric components.

As mentioned above, in fact, the control system of the appliance according to the invention, is of the electronic type, based on the use of a microcontroller having suitable non-volatile memory. According to a significant feature of the invention, the memory contains coded information related to the typical consumptions of the various electric/electronic components of the appliance (such as pumps, solenoid valves, motors, heaters, pilot lights, etc.), according to their different conditions of use.

The information is the result of practical investigations and tests and form a 'knowledge base' having the purpose of allowing the identification of the consumptions, per time unit, of the electric/electronic components of the appliance.

Therefore, assuming that in an electronic control system as described above:

- the various operating programs which can be executed by the appliance are coded within the non-volatile memory associated with the microcontroller,
- the operating programs essentially consist of actuating controls, for determined sequences and determined times, of the electric/electronic devices,
- it is the microcontroller that, on the basis of the programs, manages the operation of the electric/electronic devices
- any microcontroller is equipped with an internal clock (CLOCK).

According to the invention, coded instructions and data tables (knowledge base) are stored within the permanent memory associated with the microcontroller, for calculating the total energy consumption during an operating program executed by the appliance; such a total value is obtained by summing the various individual consumptions, i.e. the electric energy consumption of each electric/electronic component, which the control system is able to calculate on the basis of the available instructions and data, as explained above.

According to the invention, the result of the calculation of the total energy consumption of the appliance can be efficiently used for several purposes, such as to be displayed for the users 'awareness' of energy saving, or be stored within a memory for statistical purposes and always with a view to simplifying the appliance programming work for the user, as it will be better explained in the following.

Returning to FIG. 1, number 6 indicates a device for measuring the rotational speed of a basket or drum of the laundry washing machine, e.g. a speedometer dynamo.

Sensors MS send their respective signals through connections 7 to the microcontroller system LC, associated with the above mentioned memory M. The control system LC, through a connection 8, is able to drive display 1, consisting, for example, of a liquid crystal (or a LED panel or still a fluorescent panel, etc.).

Figure 2:
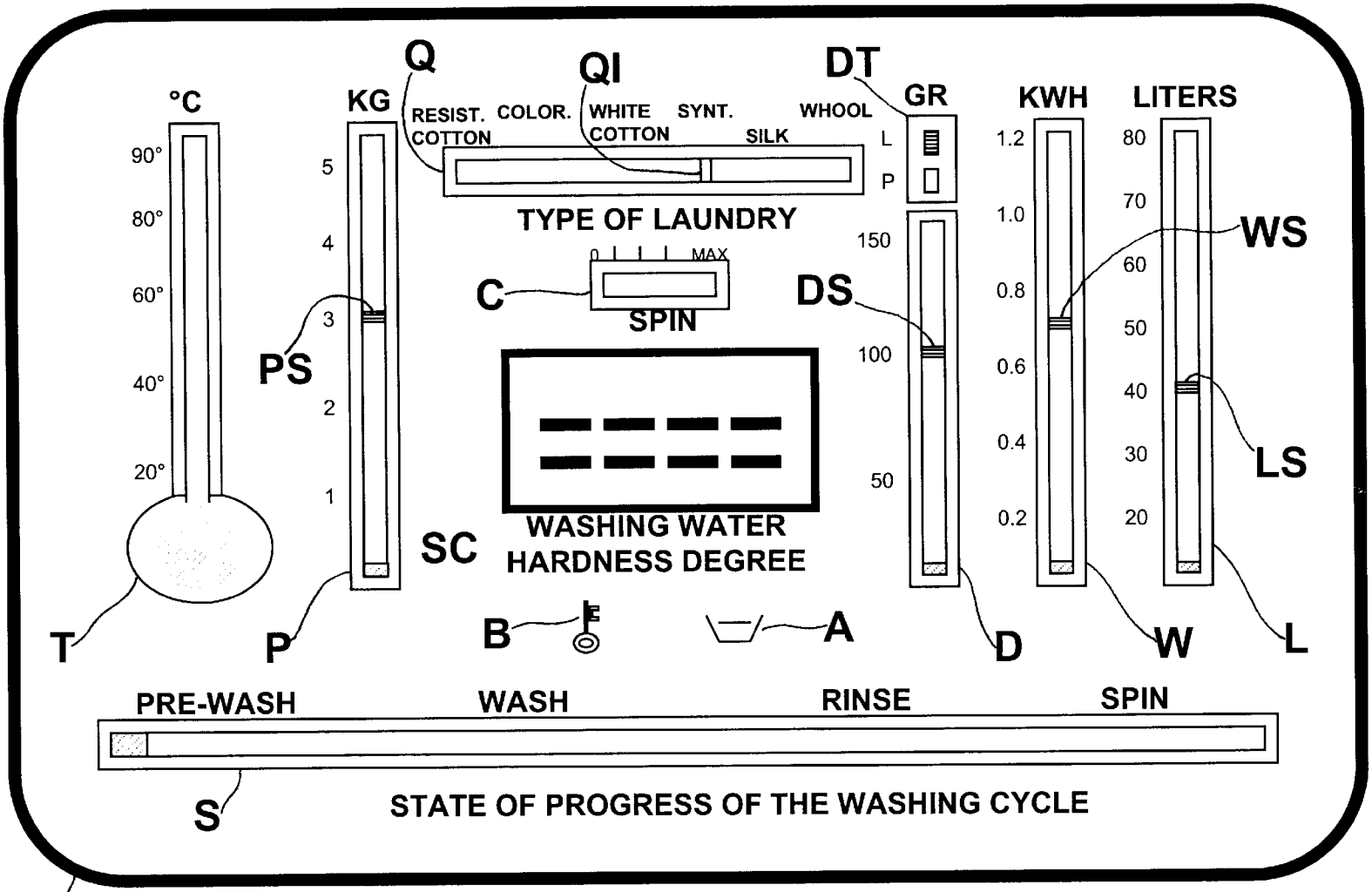
FIG. 2 shows schematically an element of the control system represented in FIG. 1 during a first operating condition.

The display 1 comprises various indicators, which can be seen in detail in FIG. 2, namely:

- a temperature indicator T,
- an indicator Q of the type of laundry, i.e. of the type of fabric being washed,
- an indicator P of the quantity of laundry,
- an indicator D of the quantity of detergent,
- an indicator DT of the type of detergent,
- an indicator W of electric energy consumption,
- an indicator L of water consumption,
- an indicator C of maximum spinning speed,
- an indicator S of the progress status of the washing cycle,
- an indicator B of the 'door locked' condition (as required by safety standards), an indicator A of the 'creasefree' option (cycle stop at the end of the last rinse, with the clothes soaked in water),
- a numerical indicator SC, suitable for displaying various information suggested by the control system LC, such as water hardness of the mains or residual time to end a washing cycle in course.

Said indicators are, in the given example, of the bar and index type, with the exception of the indicator SC, which consists of four 7-segment 'digits', of the indicator DT consisting of two luminescent segments (one for liquid detergent and the other for powder detergent) and of the indicators A and B, consisting of symbols that may be illuminated as required.

The control panel of the washing machine, not shown, is equipped with a manual setting device, for the selection of the desired functions.

Such a setting device may consist of classic knobs, keys, sliders, etc., which allow for the setting of various options related to a washing cycle, such as the selection of the type of washing, the spin speed, the washing temperature, and of special functions to be associated with a washing cycle (for instance the above 'creasefree' option).

In a preferred embodiment of the invention, the washing machine is equipped with a programming system of the type described in the European Patent Application EP-A-0 725 181.

The document describes an electronic control system for a washing machine capable of controlling the execution of a complete washing cycle as a function of one parameter alone set by the user, the parameter being related to the most delicate fabric to be washed.

In practice, such a microcontroller control system is provided with an adequate 'knowledge base' coded according to Fuzzy Logic rules, allowing the selection of the best operating parameters of the machine (i.e. the above mentioned 'actuating controls') as a function of just one 'qualitative' selection set by the user, to obtain a satisfactory washing.

However, to comply with his or her personal requirements, the user is able to change some operating parameters within given 'safety' limits, imposed by the control system itself, such as washing temperature or spin speed.

In the following description, let it then be assumed that the control system and control mechanism of the laundry washing machine described with reference to this invention are of the type disclosed in EP-A-0 725 181.

To this purpose, the laundry washing machine has therefore a selector for the type of clothes to be washed, which is used to set the washing cycle, and other additional selecting devices, which allows optional changes to the optimized operating parameters, consisting of keys to select the washing temperature and the spin speed, and keys for the control of special functions (e.g. a 'creasefree' key).

As already highlighted, the laundry washing machine is equipped with an electronic control system based on a microcontroller, advantageously programmed according to the Fuzzy Logic rules; to this purpose, the permanent memory associated with the microcontroller contain adequate information, that the control system uses for fulfilling its functions. In the case of the present invention, such information includes at least:

- programs which allows the control system to obtain useful information from the sensors MS and manage the various electric/electronic components of the machine, accordingly with such information;
- adequate knowledge base, consisting of experimental data, i.e. Information obtained through proper practical tests.

A first part of the knowledge base consists of coded data which, as the, are used by the machine control system to calculate with good approximation through sensors 3, 4 and 5, the actual water, electric energy and detergent consumption at the end of a washing cycle.

A second part of such knowledge base refers to the optimized operating parameters of the machine, depending upon the different conditions of use; the parameters allow the control system to suggest an optimized washing cycle to the user, as a function of the selection of the same user (type of fabric and, eventually the temperature, the spin speed, etc.).

According to the invention, a third part of the knowledge base refers to coded data used by the control system to indicate an estimated electric energy and water consumption to the user, as well as the optimized quantity of detergent that the user should introduce in the machine for the execution of the optimized washing cycle suggested by the control system.

The operation of the appliance according to the invention will now be described with reference to FIGS. 2–4 which represent the display 1 during several operating steps of the laundry washing machine.

FIG. 2 shows the situation when starting a washing cycle, i.e. directly after the user switches on the machine through an ON/OFF key, not shown. As it can be seen, the indicator S of the progress state of the washing cycle is on its initial position.

After introducing the clothes to be washed into the drum, the user selects the type of laundry to be washed through the above mentioned selector. The control system reacts to such a selection by displaying the type of fabric on indicator Q, through a proper index QI. In the specific case shown in FIG. 2, it is assumed that the user wishes to wash synthetic clothes.

On the basis of the information stored within the memory, and as a function of the selection made by the user, the control system gives the user himself a number of 'suggestions', which correspond to the optimized parameters for the washing cycle. To this purpose, the control system duly control the various indicators of the display 1.

Therefore, an optimized quantity of laundry (3 kg in the given example) appears on the indicator P, through an illuminated index PS, i.e. the quantity suggested by the control system LC in relation to the type of laundry selected by the user (synthetic fabrics), so as to reach a right compromise between best washing performance and the maximum saving. As it can be imagined, the control system LC will research the information about the optimized quantity of laundry within its own memory M.

The control system LC gives useful advices also with respect to the use of detergent. Specifically, the luminescent segment corresponding to the type of suggested detergent (liquid detergent in the given example) will light up on indicator DT; a luminescent index DS on indicator D shows on the other hand the quantity of (liquid) detergent suggested to the user for carrying out the cycle previously selected (a quantity of 100 grams is indicated in the given example).

Always as a function of the cycle selected by the user, the control system LC estimates both the energy and the water consumption to carry out an optimized washing, (i.e. that suggested for synthetic clothes, of 3 kg of laundry and with 100 g. of liquid detergent). The control logic LC researches, within its own memory M, the consumption information, which is estimated as a function of the type of fabric indicated by the user.

The estimation of total electric energy consumption is indicated on the energy absorption indicator W through a luminescent index WS (in the given example a consumption of 0.7 kWh is assumed); the estimation of total water consumption is instead indicated on the water consumption indicator L through a luminescent index LS (in the example a consumption of 40 liters of water is assumed).

In the example shown here, the maximum spin speed and the temperature as suggested for the washing are not yet shown by their relevant indicators C and T; the data will be shown after the user has pressed a wash start push-button, not shown here. Anyway, it should be noted that in a further embodiment of the invention also these two data could be 'suggested' before starting the washing cycle.

During that phase, the numerical indicator SC can be used by the control system to indicate the level of the water hardness; obviously this information, which is obtained by the control system through the above mentioned water resistivity sensor is a historical data (i.e. detected, stored and eventually updated in time following the washing cycles previously carried out by the machine).

Figure 3:
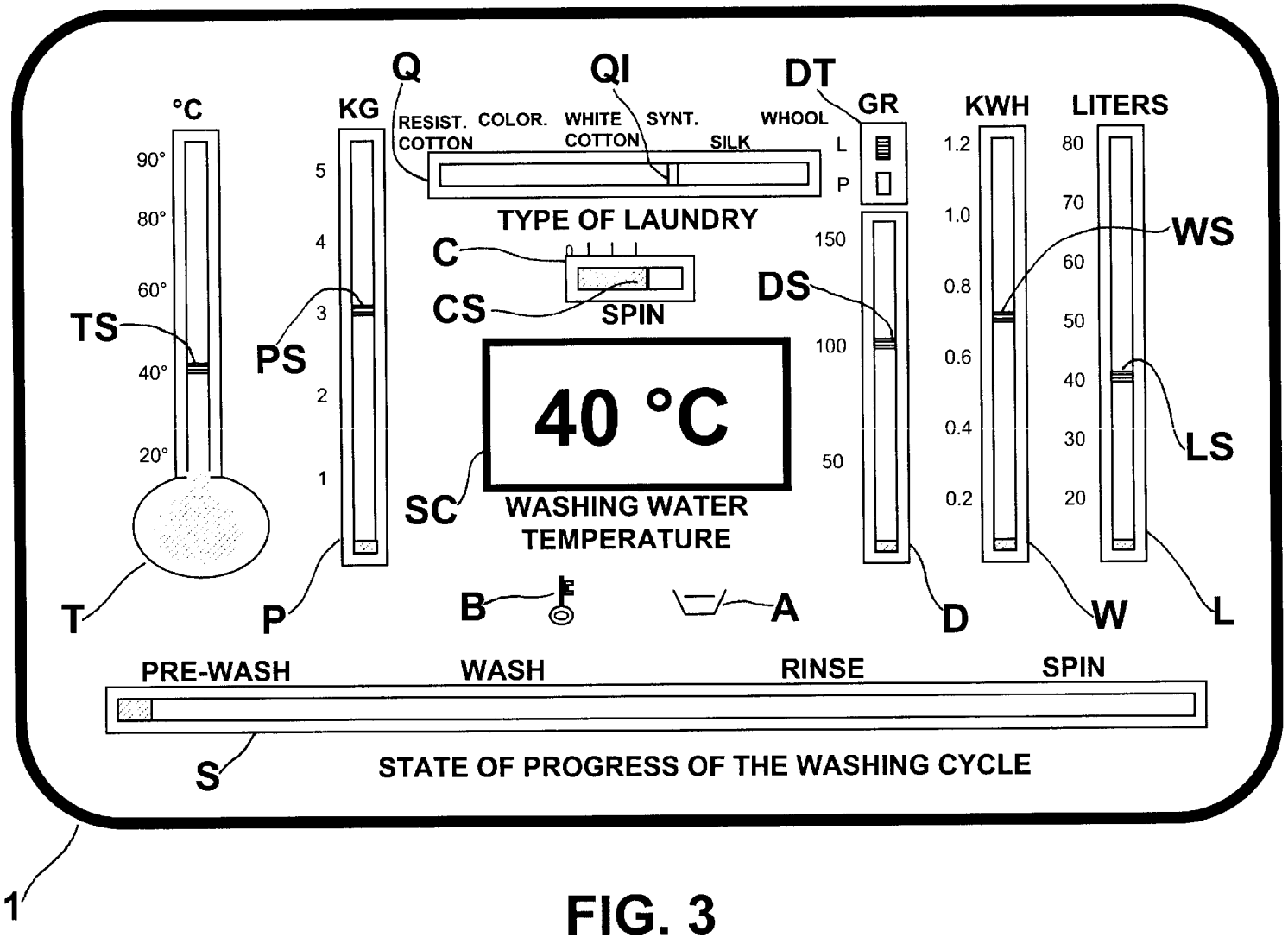
FIG. 3 shows schematically an element of the control system represented in FIG. 1 during a second operating condition.

FIG. 3 represents the situation which directly follows actuating the control to start washing, i.e. pressing the cycle start push-button.

As said, in the example, a laundry consisting of synthetic clothes has been selected by the user through the relevant selector; this choice is made final right when the user presses down the push-button: as a result, any further actuation of the selector concerning the type of laundry will be subsequently ignored by control system LC.

At this time, the temperature indicator T will show an optimized washing temperature, suggested by control system LC through a luminescent index TS; this is also displayed in a numerical/figures way for a few seconds on the numerical indicator SC (in the specific case 40° C.). If desired, the user may change the temperature through the setting device previously mentioned. The temperature changes done by the user are immediately shown on the temperature indicator T, by an index TU (which can be seen in FIG. 4) and on the numerical indicator SC in a numerical form.

Let us now assume that the user changes the temperature for instance to 50° C.

During the water heating, the height of a luminescent bar TR on the temperature indicator T will show the current temperature detected by the relevant temperature sensor 2 (FIG. 1).

The indicator C displays the maximum spin speed through a luminescent index CS; also in this case the user can change the suggested value, through the relevant setting device provided to this purpose. While the user is changing the maximum spin speed, the numerical indicator SC may show the number of revs/min.; at any rate, the speed changes made by the user are also immediately shown on the speed indicator C (relocation of the luminescent index CS).

Always with reference to FIG. 3, the remaining indicators will stay in their start positions, specifically:

- the indicator S of the state of progress of the washing cycle is still in its initial position;
- the quantity of laundry (3 kg) suggested by the control system LC, in relation with the type of laundry selected by the user (synthetic fabrics), remains indicated by the luminescent index PS on the indicator P;
- the type (liquid) and the quantity (100 grams) of the suggested detergent remain indicated on their relevant indicators DT and D, respectively through the luminescent segment associated with the liquid detergent and the index DS;
- the estimated energy consumption (0,7 kWh) remains shown by the luminescent index WS on the indicator W;
- the estimated water consumption (40 liters) remains indicated by the luminescent index LS on the indicator L.

Figure 4:
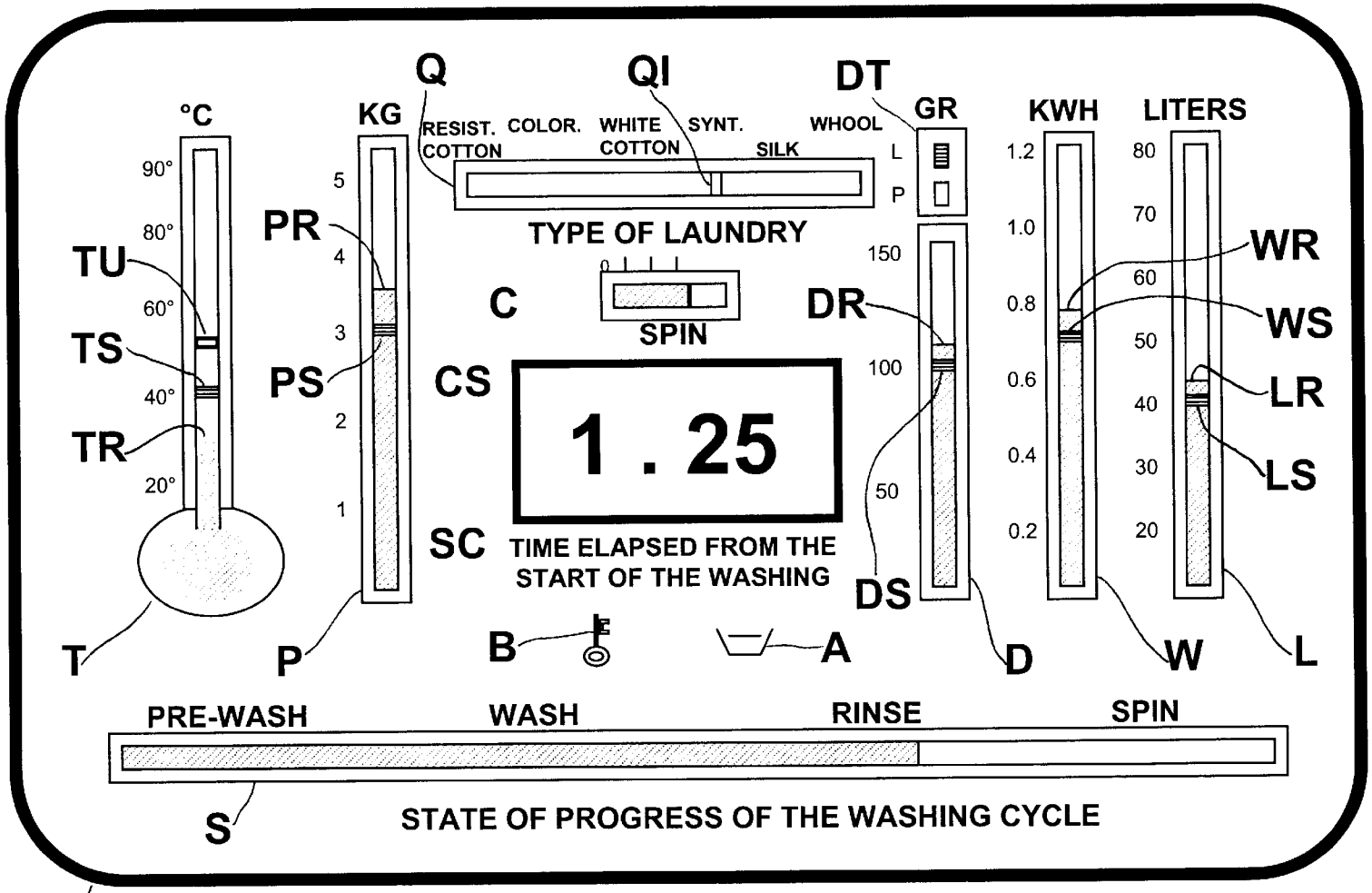
FIG. 4 shows schematically an element of the control system represented in FIG. 1 during a third operating condition.

The situation represented in FIG. 4 occurs a certain time after the start of the washing, which is 1 hour and 25 minutes in the specific case. As it can be seen, this time is highlighted on the numerical indicator SC.

The figure also shows how the indicator T retains the temperature data originally suggested by the control system through the index TS, and eventually the temperature data changed by the user through the index TU. On the other hand, the height of the illuminated bar TR indicates the temperature detected right then by the relevant temperature sensor 2 (current value of water temperature in the washing tub).

The quantity of laundry (3 kg) suggested by the control system LC in relation to the type of laundry selected by the user (synthetic fabrics) remains indicated by the luminescent index PS on the indicator P, whereas the height of an illuminated bar PR on the same indicator indicates the actual quantity of clothes loaded by the user, as detected by the control system through the analysis of the pressure switch operation 3 (in accordance with the matter described in the previously mentioned EP-A-0 649 932).

The type (liquid) and the quantity (100 grams) of detergent originally suggested by the control system remain indicated on the relevant indicators DT and D; whereas the height of an illuminated bar DR indicates the quantity of detergent detected by the control system LC, up to that moment. Therefore, this is a temporary value that will become final only at the end of the washing.

The originally estimated energy consumption (0.7 kWh) remains indicated by the index WS on the indicator W; the height of an illuminated bar WR indicates instead the actual consumption of electric energy up to that moment; also in this case, this is a temporary value that will become final only at the end of the washing.

The water consumption originally estimated (40 liters) remain indicated with a luminescent index LS on the indicator L, whereas the height of a little bar LR indicated the actual water consumption up to that moment; also in this case we are facing a provisional value that will become final only at wash end.

The indicator S of the state of progress of the washing cycle is now in line with the final part of the rinsing stage, which is reached within 1 hour-25 minutes from the cycle start.

Indicator C finally displays the maximum spin speed (e.g. a mean value) that may be eventually changed by the user through a suitable device (e.g. a knob or a couple of push-buttons for increasing or decreasing the speed till spinning is concluded).

Figure 5:
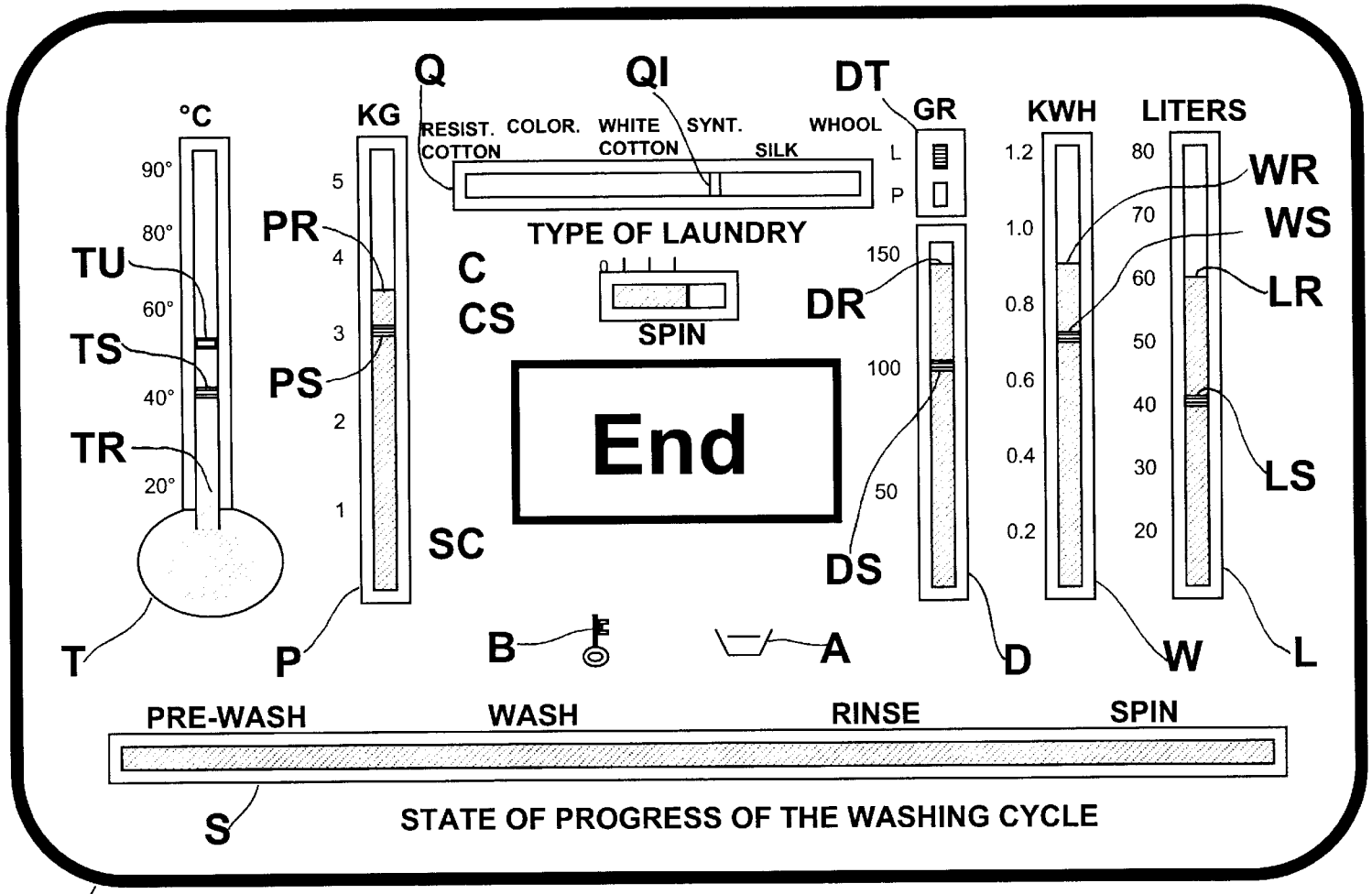
FIG. 5 shows schematically an element of the control system represented in FIG. 1 during a fourth operating condition.

The situation represented in FIG. 5 occurs after the washing cycle is over. To this purpose, the numerical indicator SC displays the word 'END' and the indicator S of the state of progress of the washing cycle has reached its final position.

The indicator T retains the temperature data originally suggested by the control system through the luminescent index TS, and eventually the temperature data changed by the user through the index TU, whereas the height of the illuminated bar TR indicates the temperature detected right at that moment by the relevant temperature sensor 2.

The quantity of laundry (3 kg) suggested by control system LC with reference to the type of clothes selected by the user (synthetic fabrics) remains indicated by the luminescent index PS, whereas the height of the illuminated bar PR indicates the actual quantity of clothes detected by the control system.

The type (liquid) and the quantity (100 grams) of detergent originally suggested by the control system remain indicated on the relevant indicators DT and D, respectively through the luminescent segment of the fluid detergent and the index DS; whereas the height of an illuminated bar DR indicates the actual total quantity of detergent detected by the control system LC.

As it can be imagined, the difference between the suggested value (DS) and the detected value (DR) represents a measurement criteria for the correct metering of the detergent by the user. The lesser the difference, the more correct the metered quantity will be.

The energy consumption (0.7 kWh) originally estimated remains indicated by the index WS on the indicator W; whereas the height of an illuminated bar WR indicates the actual consumption of electric energy. In the example, energy consumption is higher than estimated at the start by the control logic (LC), probably because the user has set a higher temperature (50° C.) than the one suggested by the control system (40° C.).

Water consumption (40 liters) originally estimated remains indicated by the luminescent index LS on the indicator L, whereas the height of an illuminated bar LR indicates actual water consumption. Also in this case a higher water consumption than that foreseen can be noticed, due to the fact that the user has loaded a higher quantity of clothes and introduced a higher quantity of detergent aid than suggested (see indicators P and D).

Finally, the indicator C will show the maximum spin speed used during the washing cycle just completed.

As it can be seen from the example above, upon termination of the washing cycle, both the indications of actual energy, water and detergent consumption determined by the user's actuations, and the values estimated by the control system at the start of the washing remain on the display, in relation with an optimized cycle 'suggested' by the control system itself.

Thus, according to the invention, the users have comparing data available and the opportunity of expressing a judgment about their own choices (for instance 'I determined a too high water consumption because the quantity of detergent I used was too high', or 'I determined a too high energy consumption because temperature I selected was too high', or 'I determined a water saving because I used liquid detergent', etc.).

Therefore, according to the present invention, it is proved how the control system of a household appliance can supply the user, under a suitable graphic and/or numerical form, by mean of a suitable display, two different types of information concerning energy, water and detergent consumption as follows:

'preliminary' information, consisting of an estimation, when each washing cycle is selected (i.e. before starting the actual washing), of the energy and water consumption being associated with the choices made from time to time by the user (program type and likely options) and with the average quantity of laundry estimated by the control system, on the basis of the data coded within its memory. The information concerning the detergent relate on the contrary to both the detergent type (liquid or powder) and the quantity; the detergent type is suggested according to the fabric characteristics (information supplied by the user: type of clothes), whereas the estimated quantity is meant as an optimized quantity, suggested by the control system to minimize the water consumption and the negative impact on the environment; 'final' information, indicating the actual energy and water consumption at the end of the washing. As regards the detergent, the quantity detected is correlated with the quantity which the control system considered the optimal one, thus giving the user a comparison term to improve the metering of the detergent.

It should be noted that, in view of the user's awareness, the control system can be easily programmed to update the 'preliminary' information on the display 1 nearly in real time, as a function of the selections actuated by the user on the provided selector.

Therefore, as it can be imagined, the 'preliminary' information play a significant 'educational' role for the user, as they report nearly instantaneously the effect of the user's choices (program type and likely other options) on the consumption of a resource supplied from an external source, such as water or electric energy.

Through the 'feedback' of the information, which the control system LC supplies to the user on the display 1, the latter will be able to look for the conditions of a minimum global consumption that can be associated with the laundry requirements (selection of a right consumption/performance compromise); to this purpose, the information concerning the quantity of detergent are also very useful for any user to acquire—washing after washing—the capability of metering correct quantities.

If the information are supplied under graphic form, as for the example in the annexed figures, it may be though of the use of a bar or index consumption display (energy, water, detergent and quantity of clothes); in this case the dialog with the user becomes very simple as it is of a qualitative type: each action by the user (program selection or option addition) corresponds to a simultaneous change of the consumption indexes, which represents the effect the action.

The characteristics of the present invention as well as its advantages are clear from the given description.

It is obvious that many changes are possible for the man skilled in the art, to the electronic control system described by way of example, without departing from the novelty spirit of the innovative solution.

For instance, the idea of using for a household appliance informative data capable of helping the user to reduce consumptions to improve the environment protection can be extended to products other than laundry washing machines; the invention can in fact also find application on dishwashers, electric or gas baking ovens and cookers, household heating boilers and in general on any household appliances absorbing a 'primary' resource, such as electric energy, water, gas, etc., whose consumptions may be in some ways affected by the user's behavior.

In the embodiment described above by way of example, the washing temperature values TS and the maximum spin speed values VS are highlighted only after the washing cycle has been started by pressing a specific key. However, it is evident that such 'preliminary' information can be made available to the user before starting the washing cycle itself, i.e. as represented in the situation of FIG. 2.

It was also mentioned above that the control system of the appliance according to the invention is capable of acquiring and storing automatically proper information related to previous washing cycles; therefore, the 'final' information can be used by the control system for updating statistical data retained by the control system itself, within a relevant non-volatile memory, to express the user's 'habits' with time.

Among the statistical data, the average quantity of laundry usually loaded by the user in the machine (also related to the different types of fabrics) can be specifically of interest.

Thus, the control system will be able to release 'preliminary' information on the display 1, based on the user's habits in relation with the average quantity of laundry being washed. In other words, when starting a washing cycle, the user who usually washes 3.5 Kg of synthetic clothes will see highlighted on display 1 the optimized or suggested temperature, quantity of detergent, spin speed, water and energy consumption values estimated in relation to the washing of 3.5 Kg synthetic clothes.

A further embodiment may concern the programming system, which can be of the type requiring a plurality of information from the user to the control system. According to this variant embodiment, the user has to set at least a couple of parameters (for instance the type and the quantity of clothes) and an optimized configuration of the operating parameters in the control system memory will correspond to the couple of values set by the user.

It should also be noted that the optimized configuration of the operating parameters of the appliance, corresponding to the choices actuated by the user (for instance the type of clothes in conjunction with weight) and the relevant consumption forecast, may be calculated on the basis of mathematical and physical models stored in the memory of the control system, instead of being recalled as pre-calculated elements pertaining to a knowledge base (in accordance with the control techniques based on the Fuzzy Logic).

It will be understood that many other changes to the household appliance described above by way of example are possible for one skilled in the art, without departing from the novelty spirit of the innovative solution, and it is also clear that in the execution of the invention components may differ in form and size from the ones described and be replaced with technically equivalent elements, without departing from the spirit and scope of the invention.

What is claimed is:

1. Apparatus for controlling consumption of energy and/or resources of a household appliance, comprising an electronic microcontroller (LC), non-volatile memory means (M) operatively connected to the microcontroller (LC), the household appliance being connected during use to at least one source of an external resource (water, electric energy, gas, etc.), the external resource being necessary to the apparatus for carrying out an operating cycle, the household appliance also comprising setting means for the manual selection of one or more operating parameters, and signaling means (1), characterized in that within the memory means (M) information are coded which the control system (LC), as a function of at least a selection operated through the setting means, uses to calculate the consumption of the external resource required by the household appliance to execute an operating cycle, the signaling means (1) comprising means for displaying the level of consumption of the external resource.

2. Apparatus according to claim 1, wherein the information comprises first coded data used by the control system (LC) to estimate the consumption of the external resource required by the household appliance to execute an operating cycle, before the operating cycle is terminated.

3. Apparatus according to claim 1, wherein the information comprises second coded data used by the control system (LC) to calculate through suitable sensor means (3,4,5), the actual consumption of the external resource by the household appliance during the execution of an operating cycle or at the end of the same.

4. Apparatus according to claim 2, wherein the signaling means (1) comprises first indicating means (W,L) for showing the estimated level (WS,LS) of the consumption of the external resource.

5. Apparatus according to claim 3, wherein the signaling means (1) comprises second indicating means (W,L) for showing the actual level (WR,LR) of the consumption of the external resource.

6. Apparatus according to claims 4, wherein the first indicating means (W,L) is suitable to show the difference between the estimated level (WS,LS) of consumption and the actual level (WR, LR) of consumption of the external resource.

7. Apparatus according to claim 1, wherein the external resource is electric energy and/or water and the signaling means (1) comprises an electric energy absorption indicator (W) and/or a water consumption indicator (L), respectively.

8. Apparatus according to claim 1, wherein the information comprises third coded data used by the control system (LC) to preset the apparatus for executing an operating cycle, being optimized as a function of at least one selection actuated through the setting means.

9. Control system, according to claim 8, wherein the household appliance is a washing machine, and the third data comprise the quantity (DS) and/or the type (DT) of suggested detergent to be used for the execution of the operating cycle considered as optimized.

10. Apparatus according to claim 8, wherein the household appliance is a laundry washing machine and the third data comprise a suggested quantity of laundry (PS) and/or a maximum spin speed (CS) to be used for the execution of the optimum operating cycle.

11. Apparatus according to claim 8, wherein the third data comprise a suggested temperature level (TS) to be set through the selection means for the execution of the operating cycle considered as optimized.

12. Apparatus according to claim 8, wherein the signaling means (1) comprises third indicator means (P,T,C) for showing the level of one or more parameters (PS,TS,CS) relating to the operating cycle considered as optimized.

13. Apparatus according to claim 8, further comprising means for changing one or more parameters (TS,CS) relating to the optimum operating cycle for the execution of a preferred operating cycle, and the signaling means (1) comprises fourth indicator means (T) for showing the modified parameters (TU) and their actual level (TR) during the preferred operating cycle or at the end of the same.

14. Apparatus according to claims 12, wherein the third indicator means (P,T,C) is able to show the likely difference between the parameters level (PS,TS,CS) relating to the operating cycle considered as optimized and the actual level (PR,TR) of the parameters relating to the preferred operating cycle.

15. Apparatus according to claim 2, wherein the first data are correlated to the user's habits (average quantity of washed laundry).

16. Apparatus according to claim 2, wherein the third data are correlated to the user's habits (average quantity of washed laundry).

17. Apparatus according to claims 3, wherein the sensor means used to calculate the actual consumption of electric energy are included in the control system (LC) and the information comprise fourth data used by the control system (LC) to calculate the consumption of electric energy during an operating cycle executed by the household appliance, the consumption value being specifically obtained by summing up the consumptions of a plurality of electric and/or electronic components of the household appliance, which are activated during the operating cycle.

18. Apparatus according to claim 4, wherein the control system (LC) is programmed for updating on the first indicator means (W,L) the estimated level (WS,LS) of the consumption of the external resource, as a function of the choices actuated by the user on the selector means, so as to instantaneously show the effects that the user's actuations have on the external resources consumption.

19. A household appliance, comprising an electronic control system according to claim 1, wherein means are provided (1) to signal preliminary information, related to an estimation of the consumption of an external resource associated with the selections made by the user, and final information relating to the actual consumption of the external resource.

20. A method of controlling the energy and/or resource consumption of a household appliance of the type having a control system with an electronic microcontroller (LC), the household appliance being operatively connected to at least a source of an external resource (water, electric energy, gas, etc.), necessary for the execution of an operating cycle of the household appliance, the household appliance also comprising setting means for manual selection of one or more operating parameters, and signaling means (1), wherein, as a function of the setting of at least one operating parameter of the appliance done by an user, the control system (LC) controls the signaling means (1) for showing a consumption level of the external resource required by the household appliance to execute an operating cycle for instructing the user on the correct setting of the operating parameters to minimize the consumption of the external resource.

21. A method, according to claim 20, wherein, as a function of the setting of the parameter, the control system (LC) controls the signaling means (1) with the purpose of showing an estimated consumption level of the external resource.

22. A method, according to claim 20, wherein, as a function of the setting of at least one operating parameter of the household appliance done by an operator, the control system (LC) controls the signaling means (1) with the purpose of showing an optimized configuration of several operating parameters of the household appliance, the optimized configurations being specifically supplied to the user for minimizing the consumption of the external resource.

23. A method, according to claim 20, wherein during an operating cycle and/or at the end of the same, the control system (LC) controls the signaling means (1) with the purpose of showing the actual consumption of the external resource used by the household appliance to execute the operating cycle.

24. A method, according to claims 20, wherein the control system (LC) controls the signaling means (1) with the purpose of showing any difference between the estimated consumption level and the actual consumption level.

25. A method, according to claim 20, wherein a signaling of preliminary information, relating to estimated consumption of the resource associated with the selections made from time to time by the user, and of final information, relating to the actual consumption of the external resource, is provided.

26. A method, according claim 20, wherein the control system (LC) acquires, stores and updates information representative of the user's habits in relation to at least one of the parameters and the control system (LC) controls the signaling means (1) for showing an optimized configuration of other operating parameters, or an estimated consumption level of the external resource, in relation to the information representative of the user's habits.

27. A method of controlling the electric energy consumption of a household appliance of the type comprising a control system with an electronic microcontroller (LC), including estimation of the total consumption of electric energy that will be reached during an operating cycle of the apparatus, the total consumption value being obtained by the calculation of the partial consumption of electric energy by each individual electric and/or electronic component of the household appliance, the partial consumptions being derived by multiplying the electric energy absorbed by each component for the time it will be activated during the operating cycle selected by the user, the total consumption of electric energy being obtained by summing up the partial consumptions.

* * * * *

UNITED STATES PATENT AND TRADEMARK OFFICE

CERTIFICATE OF CORRECTION

PATENT NO. : 6,169,964 B1
DATED : January 2, 2001
INVENTOR(S) : Valerio Aisa et al.

It is certified that error appears in the above-identified patent and that said Letters Patent is hereby corrected as shown below:

Title page,
Item [30], Foreign Application Priority Data, should read
-- Nov. 25, 1996 (IT) .....TO96A000948 --.
Below the ABSTRACT, "27 claims" should read -- 26 claims --.

Signed and Sealed this

Thirtieth Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,169,964 B1
DATED : January 2, 2001
INVENTOR(S) : Valerio Aisa et al.

It is certified that error appears in the above-identified patent and that said Letters Patent is hereby corrected as shown below:

Title page should be deleted to appear as per attached title page.

Columns 9-14 should be deleted to appear as per attached columns 9-14.

Signed and Sealed this

Thirtieth Day of May, 2006

JON W. DUDAS
*Director of the United States Patent and Trademark Office*

(12) United States Patent
Aisa et al.

(10) Patent No.: US 6,169,964 B1
(45) **Date of Patent: *Jan. 2, 2001**

(54) APPARATUS FOR CONTROLLING CONSUMPTION BY A HOUSEHOLD APPLIANCE

(75) Inventors: Valerio Aisa; Dino Bongini, both of Fabriano (IT)

(73) Assignee: Merloni Elettrodomestici S.p.A., Fabriano (IT)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/978,350

(22) Filed: Nov. 25, 1997

(30) Foreign Application Priority Data

Nov. 25, 1996 (IT) ..... TO96A0948

(51) Int. Cl.[7] ..... H02J 3/00
(52) U.S. Cl. ..... 702/136; 364/528.26; 364/528.3
(58) Field of Search ..... 702/84, 136; 364/188, 364/468.15, 468.16, 475.09, 528.26, 528.3, 528.31

(56) References Cited

U.S. PATENT DOCUMENTS

| | | | |
|---|---|---|---|
| 4,035,795 | 7/1977 | Fosnough et al. | 307/141.4 |
| 4,275,464 | 6/1981 | Schmidt | 364/186 |
| 4,583,182 | 4/1986 | Breddan | 364/528.26 |
| 4,686,630 | 8/1987 | Marsland et al. | 364/528.31 |
| 4,916,328 | 4/1990 | Culp, III | 364/528.26 |
| 5,414,640 | 5/1995 | Seem | 364/528.26 |

FOREIGN PATENT DOCUMENTS 39 32 170 4/1991 (DE).

*Primary Examiner*—Marc S. Hoff
*Assistant Examiner*—Bryan Bui
(74) *Attorney, Agent, or Firm*—Levine & Mandelbaum

(57) ABSTRACT

A system for controlling the consumption of a household appliance, comprising an electronic microcontroller and nonvolatile memory device associated with the microcontroller, the household appliance being connected during use with at least one source of an external resource (water, electric energy, gas, etc.), the external resource being required by the apparatus for carrying out an operating cycle, where the apparatus also comprises a setting device for the manual selection of one or more operating parameters, and signaling device. Coded information are contained within a memory, which are used by the control system as a function of at least one selection actuated through the setting device, for calculating the consumption of the external resource required by the household appliance to execute an operating cycle, the signaling means being capable, if required, to show the consumption level of the external resource.

26 Claims, 5 Drawing Sheets

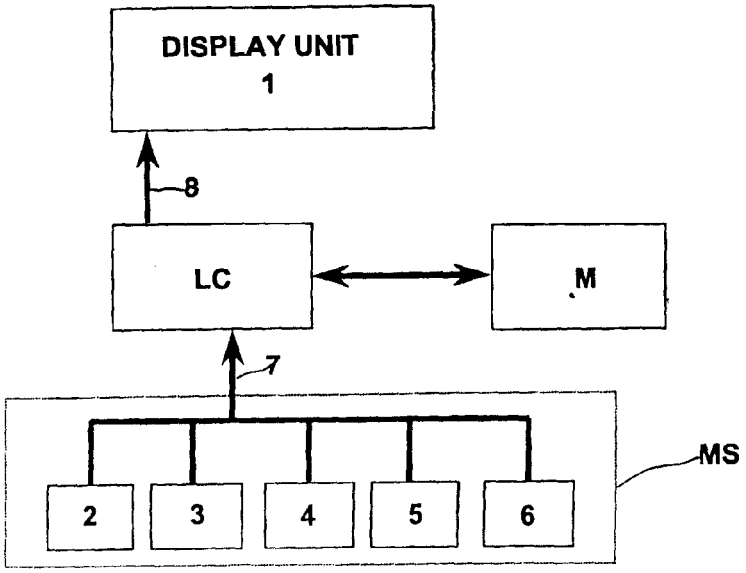

detergent I used was too high', or 'I determined a too high energy consumption because temperature I selected was too high', or 'I determined a water saving because I used liquid detergent', etc.).

Therefore, according to the present invention, it is proved how the control system of a household appliance can supply the user, under a suitable graphic and/or numerical form, by mean of a suitable display, two different types of information concerning energy, water and detergent consumption as follows:

'preliminary' information, consisting of an estimation, when each washing cycle is selected (i.e. before starting the actual washing), of the energy and water consumption being associated with the choices made from time to time by the user (program type and likely options) and with the average quantity of laundry estimated by the control system, on the basis of the data coded within its memory. The information concerning the detergent relate on the contrary to both the detergent type (liquid or powder) and the quantity; the detergent type is suggested according to the fabric characteristics (information supplied by the user: type of clothes), whereas the estimated quantity is meant as an optimized quantity, suggested by the control system to minimize the water consumption and the negative impact on the environment;

'final' information, indicating the actual energy and water consumption at the end of the washing. As regards the detergent, the quantity detected is correlated with the quantity which the control system considered the optimal one, thus giving the user a comparison term to improve the metering of the detergent.

It should be noted that, in view of the user's awareness, the control system can be easily programmed to update the 'preliminary' information on the display 1 nearly in real time, as a function of the selections actuated by the user on the provided selector.

Therefore, asherefore, as it can be imagined, the 'preliminary' information play a significant 'educational' role for the user, as they report nearly instantaneously the effect of the user's choices (program type and likely other options) on the consumption of a resource supplied from an external source, such as water or electric energy.

Through the 'feedback' of the information, which the control system LC supplies to the user on the display 1, the latter will be able to look for the conditions of a minimum global consumption that can be associated with the laundry requirements (selection of a right consumption/performance compromise); to this purpose, the information concerning the quantity of detergent are also very useful for any user to acquire—washing after washing—the capability of metering correct quantities.

If the information are supplied under graphic form, as for the example in the annexed figures, it may be though of the use of a bar or index consumption display (energy, water, detergent and quantity of clothes); in this case the dialog with the user becomes very simple as it is of a qualitative type: each action by the user (program selection or option addition) corresponds to a simultaneous change of the consumption indexes, which represents the effect the action.

The characteristics of the present invention as well as its advantages are clear from the given description.

It is obvious that many changes are possible for the man skilled in the art, to the electronic control system described by way of example, without departing from the novelty spirit of the innovative solution.

For instance, the idea of using for a household appliance informative data capable of helping the user to reduce consumptions to improve the environment protection can be extended to products other than laundry washing machines; the invention can in fact also find application on dishwashers, electric or gas baking ovens and cookers, household heating boilers and in general on any household appliances absorbing a 'primary' resource, such as electric energy, water, gas, etc., whose consumptions may be in some ways affected by the user's behavior.

In the embodiment described above by way of example, the washing temperature values TS and the maximum spin speed values VS are highlighted only after the washing cycle has been started by pressing a specific key. However, it is evident that such 'preliminary' information can be made available to the user before starting the washing cycle itself, i.e. as represented in the situation of FIG. 2.

It was also mentioned above that the control system of the appliance according to the invention is capable of acquiring and storing automatically proper information related to previous washing cycles; therefore, the 'final' information can be used by the control system for updating statistical data retained by the control system itself, within a relevant non-volatile memory, to express the user's 'habits' with time.

Among the statistical data, the average quantity of laundry usually loaded by the user in the machine (also related to the different types of fabrics) can be specifically of interest.

Thus, the control system will be able to release 'preliminary' information on the display 1, based on the user's habits in relation with the average quantity of laundry being washed. In other words, when starting a washing cycle, the user who usually washes 3.5 Kg of synthetic clothes will see highlighted on display 1 the optimized or suggested temperature, quantity of detergent, spin speed, water and energy consumption values estimated in relation to the washing of 3.5 Kg synthetic clothes.

A further embodiment may concern the programming system, which can be of the type requiring a plurality of information from the user to the control system. According to this variant embodiment, the user has to set at least a couple of parameters (for instance the type and the quantity of clothes) and an optimized configuration of the operating parameters in the control system memory will correspond to the couple of values set by the user.

It should also be noted that the optimized configuration of the operating parameters of the appliance, corresponding to the choices actuated by the user (for instance the type of clothes in conjunction with weight) and the relevant consumption forecast, may be calculated on the basis of mathematical and physical models stored in the memory of the control system, instead of being recalled as pre-calculated elements pertaining to a knowledge base (in accordance with the control techniques based on the Fuzzy Logic).

It will be understood that many other changes to the household appliance described above by way of example are possible for one skilled in the art, without departing from the novelty spirit of the innovative solution, and it is also clear that in the execution of the invention components may differ in form and size from the ones described and be replaced with technically equivalent elements, without departing from the spirit and scope of the invention.

What is claimed is:

1. Apparatus for controlling consumption of energy and/or resources of a household appliance, comprising an electronic microcontroller, non-volatile memory means operatively connected to the microcontroller, the household appliance being connected during use to at least one source of an external resource (water, electric energy, gas, etc.), the external resource being necessary to the apparatus for carrying out an operating cycle, the household appliance also comprising setting means, for the manual selection of one or more operating parameters, and signaling means, characterized in that within the memory means comprising means for displaying the level of consumption of the external resource, wherein information are coded within the memory means, which the apparatus, as a function of at least a selection operated through the setting means, uses to calculate the consumption of the external resource required by the household appliance to execute an operating cycle, the information comprising first coded data used by the control system to estimate the consumption of the external resource required by the household appliance to execute an operating cycle, before the operating cycle is terminated wherein the apparatus is programmed for updating on the signaling means the estimated level of the consumption of the external resource, as a function of the choices actuated by the user on the setting means, so as to instantaneously show the effects that the user's actuations have on the external resources consumption.

2. Apparatus according to claim 1, wherein the information comprises second coded data used by the apparatus to calculate through suitable sensor means, the actual consumption of the external resource by the household appliance during the execution of an operating cycle or at the end of the same.

3. Apparatus according to claim 1, wherein the signaling means comprises first indicating means for showing the estimated level of the consumption of the external resource.

4. Apparatus according to claim 3, wherein the sensor means used to calculate the actual consumption of electric energy are included in the apparatus and the information comprise fourth data used by the apparatus to calculate the consumption of electric energy during an operating cycle executed by the household appliance, the consumption value being specifically obtained by summing up the consumptions of a plurality of electric and/or electronic components of the household appliance, which are activated during the operating cycle.

5. Apparatus according to claim 1, wherein the signaling means comprises second indicating means for showing the actual level of the consumption of the external resource.

6. Apparatus according to wherein the signaling means is suitable to show the difference between the estimated level of consumption and the actual level of consumption of the external resource.

7. Apparatus according to claim 1, wherein the external resource is electric energy and/or water and the signaling means comprises an electric energy absorption indicator and/or a water consumption indicator, respectively.

8. Apparatus according to claim 1, wherein the ion comprises third coded data used by the control system to preset the apparatus for executing an operating cycle, being optimized as a function of at least one selection actuated the setting means.

9. Apparatus according to claim 8, the household appliance is a washing machine, and the third data comprise the quantity and/or the type of suggested detergent to be used for the execution of the operating cycle considered as optimized.

10. Apparatus according to claim 8, wherein the household appliance is a laundry washing machine and the third data comprise a suggested quantity of laundry and/or a maximum spin speed to be used for the execution of the operating cycle considered as optimum.

11. Apparatus according to claim 8, wherein the third data comprise a suggested temperature level to be set through the setting means for the execution of the operating cycle considered as optimized.

12. Apparatus according to claim 8, wherein the signaling means comprises third indicator means for showing the level of one or more parameters relating to the operating cycle considered as optimized.

13. Apparatus according to claim 12, wherein the third indicator means is able to show the likely difference between the parameters level relating to the operating cycle considered as optimized and the actual level of the parameters relating to the preferred operating cycle.

14. Apparatus according to claim 8, further comprising means for changing one or more parameters relating to the optimum operating cycle for the execution of a preferred operating cycle, and the signaling means comprises fourth indicator means for showing the modified parameters and their actual level during the preferred operating cycle or at the end of the same.

15. Apparatus according to claim 1, wherein the first data are correlated to the user's habits.

16. Apparatus according to claim 1, wherein the third data are correlated to the user's habits (average quantity of washed laundry).

17. A household appliance, comprising an apparatus according to claim 1, wherein means are provided to signal preliminary information, related to an estimation of the consumption of an external resource associated with the selections made by the user, and final information relating to the actual consumption of the external resource.

18. A method of controlling the energy and/or resource consumption of a household appliance of the type having a control system with an electronic microcontroller, the household appliance being operatively connected to at least a source of an external resource (water, electric energy, gas, etc.), necessary for the execution of an operating cycle of the household appliance, the household appliance also comprising setting means for manual selection of one or more operating parameters, and signaling means, wherein, as a function of the setting of at least one operating parameter of the appliance done by a user, the control system controls the signaling means for showing a consumption level of the external resource required by the household appliance to execute an operating cycle for instructing the user on the correct setting of the operating parameters to minimize the consumption of the external resources, wherein, as a function of the setting of at least one operating parameter of the household appliance done by the user, the control system controls the signaling means with the purpose of showing an optimized configuration of several operating parameters of the household appliance.

19. A method, according to claim 18, wherein, as a function of the setting of the parameter, the control system controls the signaling means with the purpose of showing an estimated consumption level of the external resource.

20. A method, according to claim 18, wherein during an operating cycle and/or at the end of the same, the control system controls the signaling means with the purpose of showing the actual consumption of the external resource used by the household appliance to execute the operating cycle.

21. A method, according to claims 18, wherein the control system controls the signaling means with the purpose of showing any difference between the estimated consumption level and the actual consumption level.

22. A method, according to claim 18, wherein a signaling of preliminary information, relating to estimated consumption of the resource associated with the selections made from time to time by the user, and of final information, relating to the actual consumption of the external resource, is provided.

23. A method, according claim 18, wherein the control system acquires, stores and updates information representative of the user's habits in relation to at least one of the parameters and the control system controls the signaling means for showing an optimized configuration of other operating parameters, or an estimated consumption level of the external resource, in relation to the information representative of the user's habits.

24. A method of controlling the electric energy consumption of a household appliance of the type comprising a control system with an electronic microcontroller, including estimation of the total consumption of electric energy that will be reached during an operating cycle of the appliance, the total consumption value being obtained by the calculation of the partial consumption of electric energy by each individual electric and/or electronic component of the household appliance, the partial consumptions being derived by multiplying the electric energy absorbed by each component for the time it will be activated during the operating cycle selected by the user, the total consumption of electric energy being obtained by summing up the partial consumptions.

25. Apparatus for controlling consumption of energy and/or resources of a household appliance, comprising an electronic microcontroller, non-volatile memory means operatively connected to the microcontroller, the household appliance being connected during use with at least one source of an external resource (water, electric energy, gas, etc.), the external resource being necessary to the apparatus for carrying out an operating cycle, the household appliance also comprising setting means for the manual selection of one or more operating parameters, and signaling means, wherein within the memory means information are coded which the apparatus, as a function of at least a selection operated through said setting means, uses to calculate the consumption of the external resource required by the household appliances to execute an operating cycle, the signaling means comprising means for displaying the level of consumption of the external resource, the information comprising first coded data used by the control system to estimate the consumption of the external resource required by the household appliance to execute an operating cycle, before that said operating cycle is terminated, and second coded data used by the control system to calculate through suitable tensor means, the actual consumption of the external resource by the household appliance during the execution of an operating cycle or at the end of the same, wherein the signaling means are suitable to show, the estimated level of the consumption of the external resource, the actual level of the consumption of the external resource, and the difference between the estimated level of consumption and the actual level of consumption of the external resource.

26. Apparatus for controlling consumption of energy and/or resources of a household appliance, comprising an electronic microcontroller, non-volatile memory means operatively connected to the microcontroller, the household appliance being connected during use with at least one source of an external resource (water, electric energy, gas, etc.), the external resource being necessary to the apparatus for carrying out an operating cycle, the household appliance also comprising setting means for the manual selection of one or more operating parameters, and signaling means, wherein within the memory means information are coded which the apparatus, as a function of at least a selection operated through said setting means, uses to calculate the consumption of the external resource required by the household appliances to execute an operating cycle, the signaling means comprising means for displaying the level of consumption of the external resource, wherein the information comprises coded data used by the control system to preset the apparatus for executing an operating cycle being optimized as a function of the changing of at least one of the parameters actuated through the setting means.

* * * * *